United States Patent [19]

Koriyama et al.

[11] Patent Number: 4,596,276

[45] Date of Patent: Jun. 24, 1986

[54] WEFT PICKING DEVICE OF AIR JET LOOM

[75] Inventors: Masayuki Koriyama, Tokyo; Kimimasa Onishi; Takao Takahashi, both of Hachioji, all of Japan

[73] Assignee: Nissan Motor Co., Ltd., Yokohama, Japan

[21] Appl. No.: 716,610

[22] Filed: Mar. 28, 1985

Related U.S. Application Data

[63] Continuation of Ser. No. 494,531, May 13, 1983, abandoned.

[30] Foreign Application Priority Data

May 26, 1982 [JP] Japan ..... 57-88033

[51] Int. Cl.[4] ..... D03D 47/30

[52] U.S. Cl. ..... 139/435

[58] Field of Search ..... 139/435; 226/97

[56] References Cited

U.S. PATENT DOCUMENTS 4,354,533 10/1982 Suzuki et al. ..... 139/435
4,391,305 7/1983 Takahashi ..... 139/435

FOREIGN PATENT DOCUMENTS 0053216 11/1980 European Pat. Off. .
2212455 7/1974 France ..... 139/435
2043717 10/1980 United Kingdom .
2097828 11/1982 United Kingdom .

OTHER PUBLICATIONS

European Search Report.

*Primary Examiner*—Henry S. Jaudon
*Attorney, Agent, or Firm*—Schwartz, Jeffery, Schwaab, Mack, Blumenthal & Evans

[57] ABSTRACT

A weft picking device of an air jet loom, comprises a plurality of air guide members spaced one from the other and in alignment with the direction of weft insertion. Each air guide member is formed with an air guide opening which forms part of a weft guide channel. Additionally, a plurality of auxiliary nozzles are disposed at certain intervals along the weft guide channel. Each auxiliary nozzle is in the shape of a hollow rod and formed at the wall thereof with an air ejection opening. The outer diameter of each auxiliary nozzle is smaller than the thickness of the air guide member. At least an upper part, having the air ejection opening, of the auxiliary nozzle is located between two opposing planes defining the thickness of the air guide member, thereby preventing the warp yarns from rubbing contact with the auxiliary nozzles.

8 Claims, 7 Drawing Figures

WEFT PICKING DEVICE OF AIR JET LOOM

This is a continuation of application Ser. No. 494,531 filed May 13, 1983, now abandoned.

BACKGROUND OF THE INVENTION

1. Field of the Invention

This invention relates in general to an improvement in a weft picking device of an air jet loom, and more particularly to an arrangement of auxiliary nozzles to prevent the rubbing contact of the auxiliary nozzles with warp yarns.

2. Description of the Prior Art

In connection with air jet looms of the type wherein conveying a weft yarn into the shed of warp yarns is achieved at least under the influence of air jets from auxiliary nozzles, the auxiliary nozzles are disposed spaced one from the other and along a weft guide channel. Accordingly, the auxiliary nozzles unavoidably come into rubbing contact with the warp yarns when a reed moves forward during the beating-up motion thereof and when the reed moves backward after completion of the beating-up motion. Such rubbing contact will cause the warp yarns to become nappy while inviting mispick due to the incomplete shedding of the warp yarns.

SUMMARY OF THE INVENTION

A weft picking device of an air jet loom, according to the present invention comprises a plurality of air guide members spaced one from the other and in alignment with the direction of weft insertion. Each air guide member is formed with an air guide opening which forms part of a weft guide channel through which a weft yarn is picked into the shed of warp yarns. Additionally, a plurality of auxiliary nozzles are disposed at predetermined intervals along the weft guide channel. Each auxiliary nozzle is in the shape of a hollow rod and formed with an air ejection opening at the peripheral wall thereof. The outer diameter of each auxiliary nozzle is smaller than the thickness of the air guide member located adjacent said auxiliary nozzle. At least an upper part, having the air ejection opening, of the auxiliary nozzle is located between two opposing planes defining the thickness of the air guide member.

Consequently, the warp yarns are prevented from rubbing contact with the auxiliary nozzles, thereby preventing the warp yarns from becoming nappy while avoiding mispick due to incomplete warp shedding.

BRIEF DESCRIPTION OF THE DRAWINGS

The features and advantages of the weft picking device according to the present invention will be more clearly appreciated from the following description taken in conjunction with the accompanying drawings in which like reference numerals designate like parts and elements throughout the various embodiments, in which.

DETAILED DESCRIPTION OF THE INVENTION

Figure 1:
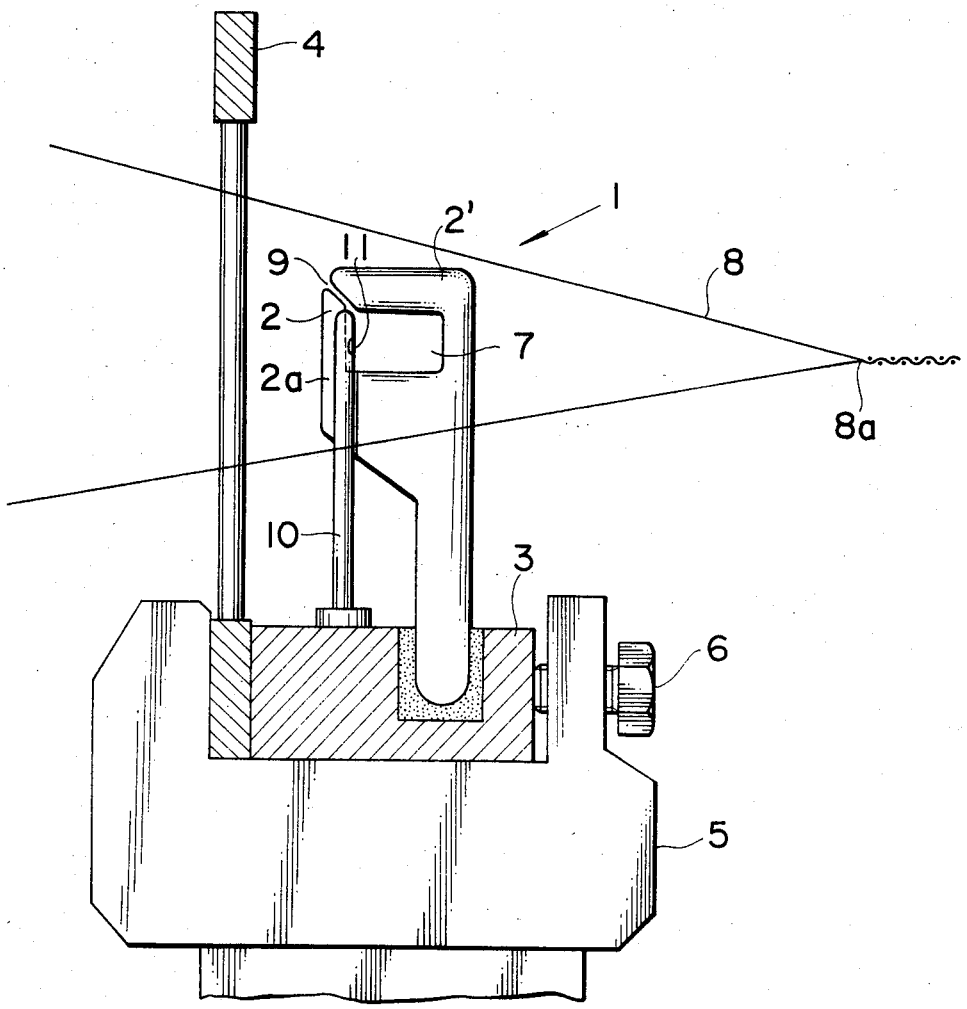
FIG.1 (PRIOR ART)
FIG. 1 is a side view, partly in section, of a conventional weft picking device of an air jet loom.
Figure 2:
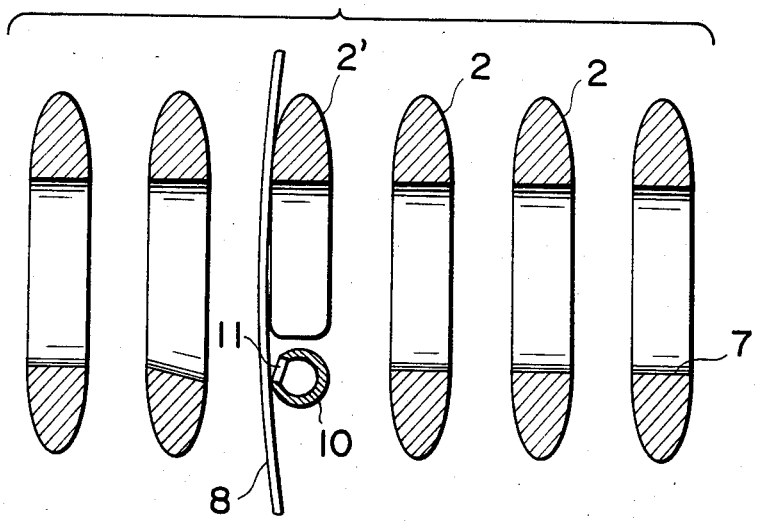
FIG. 2 (PRIOR ART)
FIG. 2 is a transverse sectional view of an essential part of the weft picking device of FIG. 1.

To facilitate understanding the present invention, a brief reference will be made to a conventional weft picking device of an air jet loom, depicted in FIGS. 1 and 2. Referring to FIGS. 1 and 2, the conventional weft picking device 1 is shown having a plurality of air guide members 2, 2'. Each air guide member 2 (2') is fixedly planted in an air guide holder 3 which is fixedly disposed together with a reed 4 within a groove (no numeral) of a reed holder 5 by means of bolts 6. The air guide members 2, 2' are located spaced one from the other and in alignment with the direction of weft picking. Each air guide member 2, 2' is formed with an air guide opening 7 forming part of a weft guide channel (no numeral) through which a weft yarn (not shown) is picked into the shed of warp yarns 8. The air guide member 2 is further formed with a slit 9 through which the weft yarn gets out of the air guide opening 7. Additionally, a plurality of auxiliary nozzles 10 are planted in the air guide holder 3 and located at suitable intervals along the weft guide channel. Each auxiliary nozzle 10 is in the shape of a hollow rod and formed at its peripheral wall with an air ejection opening 11 through which pressurized air is obliquely ejected into the weft guide channel, thus conveying the weft yarn from a weft inserting nozzle (not shown) under the influence of air jet ejection from the auxiliary nozzles 10. Otherwise, conveying the weft yarn may be achieved under the cooperation of the air jet ejections from the weft inserting nozzle and the auxiliary nozzles 10.

As shown, the air guide member 2 are each a one piece construction and are of a so-called closed type wherein a substantially closed loop section (no numeral) is formed except for the slit 9 so as to define the air guide opening 7 at the inner periphery thereof. However, the air guide members 2' located at the positions corresponding to the auxiliary nozzles 10 are of a so-called open type wherein a vertical portion **2*a* is omitted so as to locate the auxiliary nozzle 8** there.

With this arrangement, the outer diameter of the auxiliary nozzle 10 is generally the same as the thickness of the air guide member 2 (2') as shown in FIG. 2. Besides, the auxiliary nozzle 10 is disposed separate from the air guide member 2'. As a result, the warp yarns 8 unavoidably come into rubbing contact with the auxiliary nozzle 10 as clearly shown in FIG. 2. More specifically, during the beating-up motion of the reed 4, the warp yarns 8 are distributed by the air guide member 2 upon the movement of the reed 4 toward the cloth fell **8*a*. At this time, for example ten warp yarns lie one upon another, one of which warp yarns is shown in FIG. 2. Such warp yarn location occurs the same also when the reed 4 moves backward in the direction far from the cloth fell 8*a* after the completion of the beating-up motion of the reed 4**.

In these processes where the warp yarns 8 are distributed into the opposite sides of the air guide member 2', the warp yarns 8 unavoidably come into rubbing contact with the auxiliary nozzle air ejection opening 11 which is located to eject air jet obliquely. This causes fine yarns such as filament yarns to become nappy, thereby making longitudinal streaks on a woven fabric while causing mispick due to incomplete warp shedding.

Figure 4:
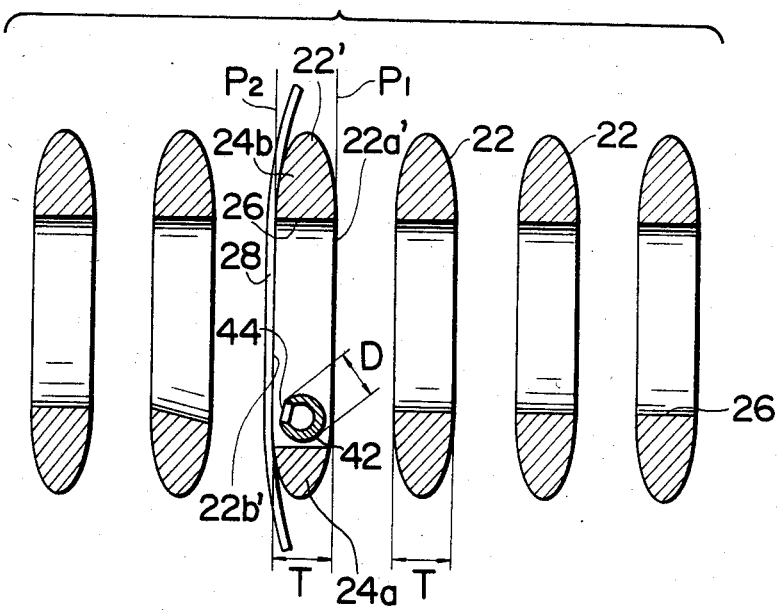
FIG. 4 is a transverse sectional view of an essential part of the weft picking device of FIG. 3.
Figure 3:
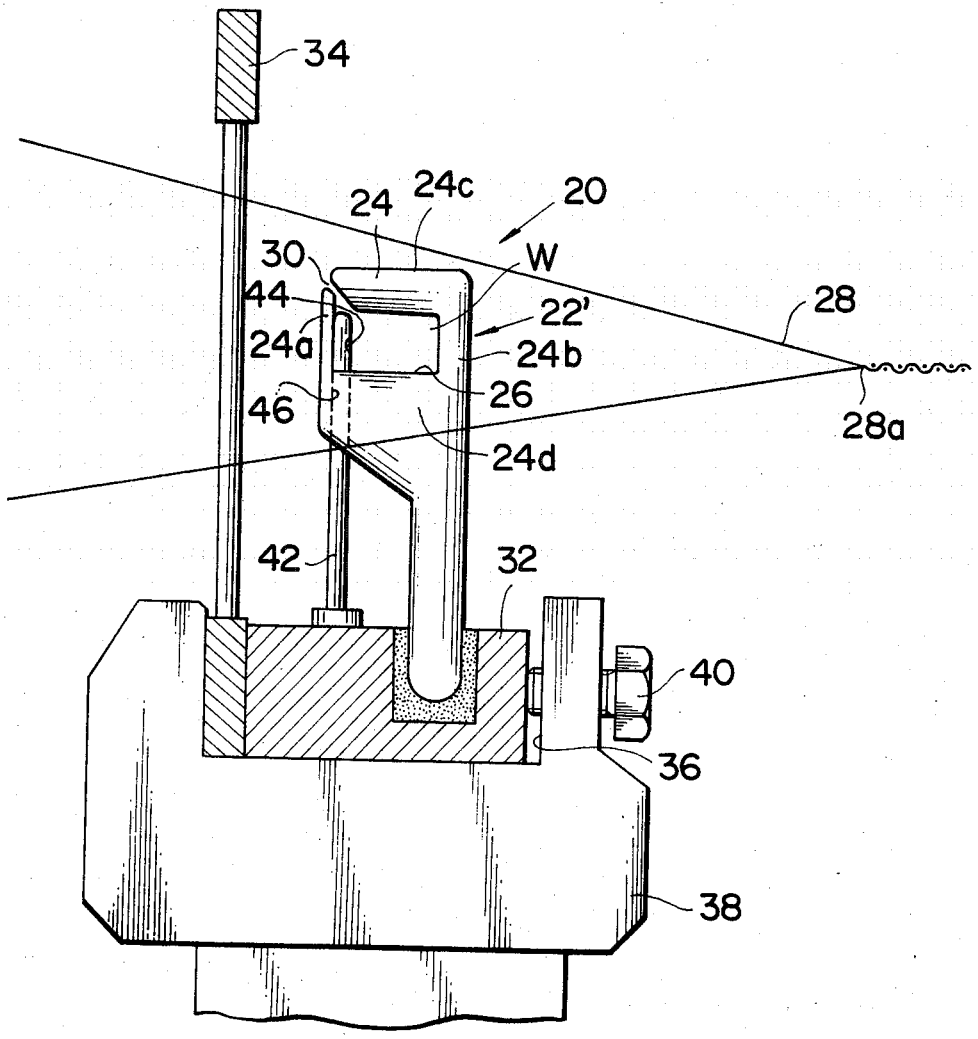
FIG. 3 is a side view, partly in section, of an embodiment of a weft picking device of an air jet loom, in accordance with the present invention.

In view of the above description of the conventional weft picking device, reference is now made to FIGS. 3 to 7, and more specifically to FIGS. 3 and 4, wherein a preferred embodiment of the weft picking device of an air jet loom, of the present invention is illustrated by the reference numeral 20. The weft picking device 20 comprises a plurality of air guide members 22, 22' of the so-called closed type wherein the air guide member 22 is provided with a substantially closed loop section 24. The closed loop section 24 is, in this case, generally rectangular and includes two opposing vertical portions 24*a* and 24*b*, and two opposing horizontal portions 24*c* and 24*d*. The four portions 24*a* to 24*c* define at their inner peripheries a generally rectangular air guide opening 26 which forms part of a weft guide channel W through which a weft yarn (not shown) from a weft inserting nozzle (not shown) is picked into the shed of warp yarns 28. The reference numeral 28*a* denotes a cloth fell. The closed loop section 24 is formed with a slit 30 through which the weft yarn gets out of the air guide opening 26. The air guide members 22, 22' are disposed spaced one from the other and in alignment with the direction of weft insertion, and fixedly stand in an air guide holder 32. The air guide holder 32 is securely disposed together with a reed 34 within a groove 36 formed in a reed holder 38 by means of bolts 40. It is to be noted that, in this embodiment, all the air guide members 22, 22' are of the closed type.

A plurality of auxiliary nozzles 42 are planted in the air guide holder 32 and located at suitable intervals along the weft guide channel W. Each auxiliary nozzle 42 is of the type of a straight hollow rod or cylinder, and formed at its peripheral wall or cylindrical wall with an air ejection opening 44 through which air jet is ejected into the weft guide channel W. The air ejection opening 44 is so formed as to obliquely an eject air jet relative to the weft guide channel W.

As shown in FIG. 3, a certain number of the air guide members 22' are respectively formed with through-holes 46 which are formed vertically piercing the bottom part or horizontal portion 24*d* of the closed loop section 24. A part of the auxiliary nozzle 42 is located within the through-hole 46 so that the tip section or upper part of the auxiliary nozzle 42 is projected into the air guide opening 26. The tip section is formed with the air ejection opening 44 and located adjacent the inner periphery of the vertical portion 24*a* of the air guide member closed loop section 24. In the air guide member 22', the air guide opening 26 is enlarged at the side of the vertical portion 24*a*, as compared with the usual air guide members 22.

It is to be noted that the outer diameter D of the auxiliary nozzle is smaller than the thickness T of the air guide member 22' (22). Accordingly, the tip section of the auxiliary nozzle 42 is located between two opposing vertical planes $P_1$ and $P_2$ which define the thickness of the air guide member 22'. The vertical planes $P_1$ and $P_2$ correspond respectively to the opposing vertical side surfaces 22*a'* and 22*b'* of the air guide member 22'.

With the thus arranged weft picking device 20, since each auxiliary nozzle 42 is located between the opposite side surfaces 22*a'* and 22*b'* of the air guide member 22', the warp yarns 28 are prevented from rubbing contact with the auxiliary nozzle 42. Further, this effectively avoids the rubbing contact of the warp yarns 28 with the air ejection opening 44 which contact is particularly critical, thereby preventing the warp yarns from becoming nappy. Accordingly, the problem of forming longitudinal streaks on a woven fabric can be solved, while avoiding mispick caused by incomplete warp shedding due to friction between the warp yarns 28 and the auxiliary nozzles 42.

It will be understood that the closed type air guide members are also used at the positions corresponding to the auxiliary nozzles and consequently air guide action for weft picking is improved as compared with a case where the open type air guide members are used at the positions corresponding to the auxiliary nozzles. Furthermore, the locational relationship between the air guide member 22' and the auxiliary nozzle 42 is predetermined, the assembly of the weft picking device is facilitated while improving assembly precision of the weft picking device.

Figure 5:
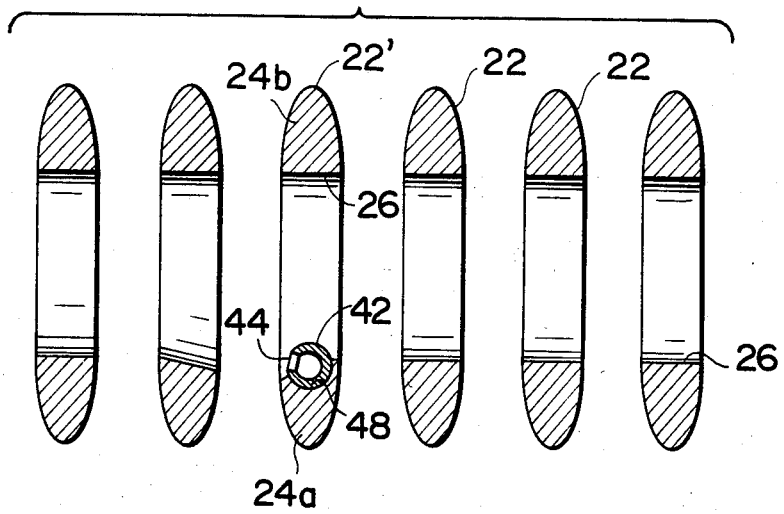
FIG. 5 is a transverse sectional view similar to FIG. 4, but showing another embodiment of the weft picking device in accordance with the present invention.

FIG. 5 shows another embodiment of the weft picking device in accordance with the present invention, in which a part of the auxiliary nozzle 42 is disposed within a vertical groove 48 formed on the vertical portion 24*a* of the closed loop section 24 which vertical portion is located at the side of the reed 34. In this case, the air guide members 22' in connection with the auxiliary nozzles 42 are produced merely by drilling the usual air guide members 22, thereby achieving cost reduction. It will be understood that each auxiliary nozzle 42 is so constructed as to be rotatable around the axis thereof in order that the air ejection direction of the auxiliary nozzle 42 is easily adjustable.

Figure 7:
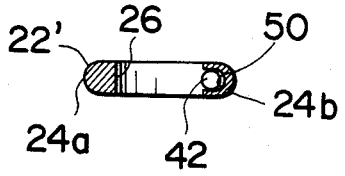
FIG. 7 is a transverse sectional view taken in the direction of the arrows and substantially along the line VII—VII of FIG. 6.
Figure 6:
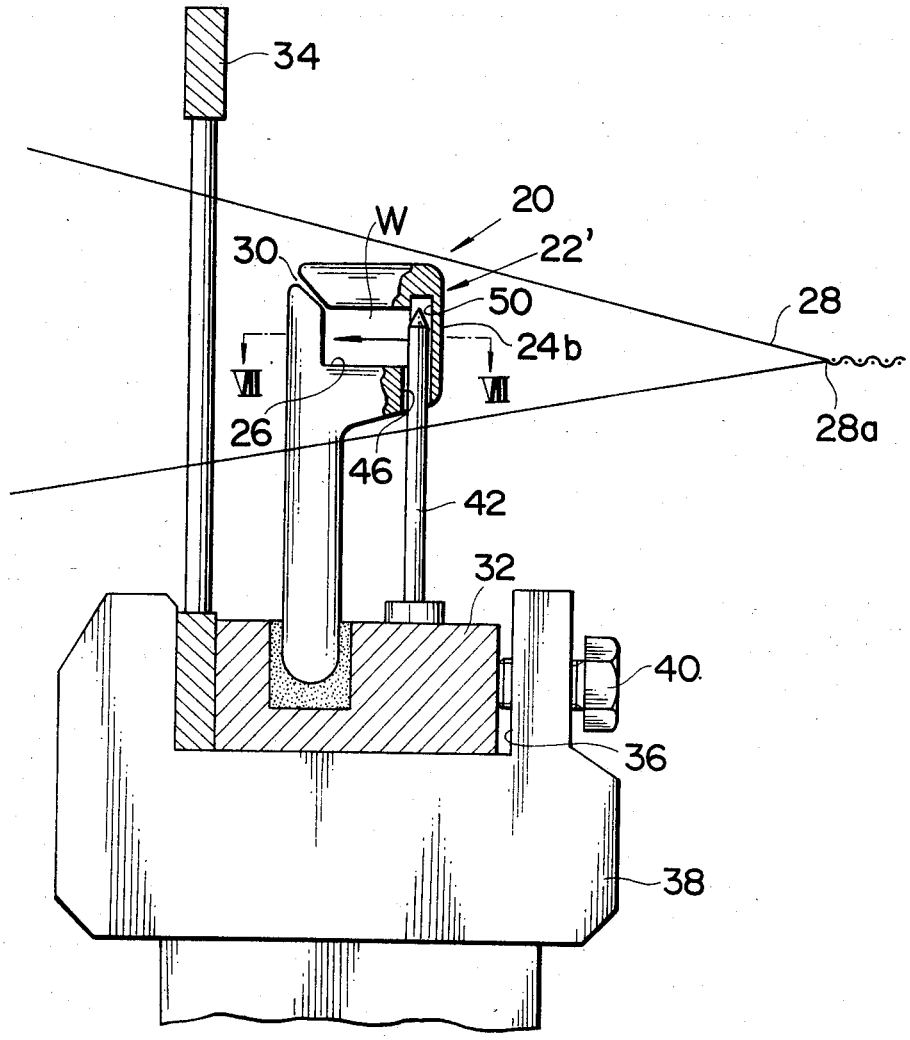
FIG. 6 is a side view, partly in section, of a further embodiment of the weft picking device in accordance with the present invention.

FIGS. 6 and 7 show a further embodiment of the weft picking device in accordance with the present invention, in which a vertical groove or channel 50 is formed on the vertical portion 24*b* of the closed loop section 24 of the air guide member 22' which vertical portion is located far from the reed 34 as compared with the vertical portion 24*a*. The vertical groove 50 in this case is located in opposition to the vertical groove 48 in the case of FIG. 5, relative to the axis of the air guide opening 26 of the air guide member 22'. As shown, the tip section of the auxiliary nozzle 42 is disposed in tight contact with the air guide member 22' within the vertical groove 50 so that no clearance is formed between an axial cylindrical wall surface of the auxiliary nozzle tip end section and the inner periphery of the air guide member and arranged to eject an air jet in the direction indicated by an arrow.

As is appreciated from the above, according to the present invention, the outer diameter of the auxiliary nozzle is made smaller than the thickness of the air guide member in order that the auxiliary nozzle is located between the opposing two vertical planes defining the thickness of the air guide member. As a result, the warp yarns are prevented from rubbing contact with the auxiliary nozzle, particularly with the air ejection opening thereof. This prevents even fine yarns such as filament yarns from becoming nappy, thereby avoiding occurrence of longitudinal streaks on a woven fabric. Besides, the reduction of mispick due to incomplete warp shedding can be effectively achieved.

What is claimed is:

1. A weft picking device of an air jet loom, comprising:

a plurality of air guide members spaced one from the other and in alignment with the direction of weft insertion, each air guide member being a one piece construction and being formed in a substantially closed loop with an inner periphery defining an air guide opening which forms part of a weft guide channel through which a weft yarn from a weft inserting nozzle is picked into the shet of warp yarns, each said air guide member having two substantially vertical portions and two substantially horizontal portions; and a plurality of auxiliary nozzles disposed at predetermined intervals along said weft guide channel, at least a part of each auxiliary nozzle being located in a through hole formed in a horizontal portion of an associated one of said air guide members and in a channel formed in a vertical portion of the associated air guide member so as to be in tight contact with the associated air guide member, each said auxiliary nozzle being in the shape of a hollow rod and including a tip end section having a wall with an air ejection opening, the outer diameter of each auxiliary nozzle being smaller than the thickness of each associated air guide member at least at an upper part of each said auxiliary nozzle having said tip end section and said air ejection opening, said associated auziliary nozzle being located between two opposing planes defining the thickness of said associated air guide member, and being received within the associated air guide member such that the ejection opening of said associated auxiliary nozzle is located in the air guide opening of the associated air guide member and directed to eject air obliquely relative to the weft guide channel, and such that no clearance is formed between an axial cylindrical wall surface of said auxiliary nozzle tip end section and said inner periphery of said air guide member.

2. A weft picking device as claimed in claim 1, wherein each air guide member includes means defining a slit through which a weft yarn gets out of the air guide opening.

3. A weft picking device as claimed in claim 2, wherein said substantially closed loop section of said air guide member is generally of a rectangular shape, and said two substantially vertical portions comprise first and second vertical portions which are in opposition to each other, said first vertical portion being located between said second vertical portion and a reed, and said two substantially horizontal portions comprise first and second horizontal portions which are in opposition to each other, said first horizontal portion being located above said second horizontal portion in the direction of the height of said air guide member.

4. A weft picking device as claimed in claim 3, wherein said through-hole of said air guide member is formed through said second horizontal portion of said substantially closed loop section.

5. A weft picking device as claimed in claim 4, wherein said auxiliary nozzle is so located that said upper part thereof is positioned adjacent the first vertical portion of said substantially closed loop section.

6. A weft picking device as claimed in claim 3, wherein said channel defines a vertical groove formed on said first vertical portion of said substantially closed loop section of said air guide member, said vertical groove being merged in the air guide opening of said air guide member, said upper part of said auxiliary nozzle being disposed within said vertical groove.

7. A weft picking device as claimed in claim 3, wherein said channel defines a vertical groove formed on said second vertical portion of said substantially closed loop section of said air guide member, said vertical groove being merged in said air guide opening of said air guide member, said upper part of said auxiliary nozzle being disposed within said vertical groove.

8. A weft picking device of an air jet loom, comprising:

a plurality of air guide members spaced one from the other and in alignment with the direction of weft insertion, each air guide member being a one piece construction and being formed in a substantially closed loop section with an inner periphery which defines an air guide opening which forms part of a weft guide channel through which a weft yarn from a weft inserting nozzle is picked into a shed of warp yarns, each said air guide member having two substantially vertical portions and two substantially horizontal portions, each said air guide member including means defining a slit through which a weft yarn may be removed from the air guide opening, said substantially closed loop section being generally of a rectangular shape and each said vertical portion having an inner vertical surface defining a portion of said inner periphery; and a plurality of auxiliary nozzles disposed at predetermined intervals along said weft guide channel, at least a part of each auxiliary nozzle being located in a through hole formed in a horizontal portion of an associated one of said air guide members and in a channel formed in a vertical portion of the associated air guide member so as to be in tight contact with the associated air guide member, each said auxiliary nozzle being in the shape of a hollow rod and including a tip end section having a wall with an air ejection opening, the outer diameter of each auxiliary nozzle being smaller than the thickness of each associated air guide member at least at an upper part of each said auxiliary nozzle having said tip end section and said air ejection opening, said associated auxiliary nozzle being located between two opposing planes defining the thickness of said associated air guide member, and being received within the associated air guide member such that the ejection opening of each auxiliary nozzle is located in the air guide opening of the associated air guide member and directed to eject air obliquely relative to the weft guide channel, said auxiliary nozzle tip and section being received within said air guide member vertical portion such that there is no clearance between a cylindrical wall surface of said auxiliary nozzle tip end section and the inner vertical surface of said air guide member vertical portion, and such that a portion of said cylindrical wall surface is substantially tangent to the plane of said inner vertical surface.

* * * * *